US011789396B2

(12) United States Patent
Koike

(10) Patent No.: US 11,789,396 B2
(45) **Date of Patent: *Oct. 17, 2023**

(54) IMAGE FORMING APPARATUS AND TONER CARTRIDGE

(71) Applicant: TOSHIBA TEC KABUSHIKI KAISHA, Tokyo (JP)

(72) Inventor: Sho Koike, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/750,013

(22) Filed: May 20, 2022

(65) Prior Publication Data

US 2022/0276581 A1 Sep. 1, 2022

Related U.S. Application Data

(63) Continuation of application No. 17/168,449, filed on Feb. 5, 2021, now Pat. No. 11,347,161.

(51) Int. Cl.
*G03G 15/00* (2006.01)
*G03G 15/08* (2006.01)

(52) U.S. Cl.
CPC ..... *G03G 15/556* (2013.01); *G03G 15/086* (2013.01); *G03G 15/0851* (2013.01); *G03G 15/0865* (2013.01); *G03G 15/0889* (2013.01)

(58) Field of Classification Search
CPC ..... G03G 15/0851; G03G 15/0865; G03G 15/0889; G03G 15/0856; G03G 2215/0888
See application file for complete search history.

(56) References Cited

U.S. PATENT DOCUMENTS

| | | | | |
|---|---|---|---|---|
| 6,282,384 | B1 | 8/2001 | Saito et al. | |
| 11,347,161 | B1 * | 5/2022 | Koike | G03G 15/0865 |
| 2001/0022905 | A1 | 9/2001 | Kosuge et al. | |
| 2003/0123888 | A1 | 7/2003 | Naito et al. | |

(Continued)

FOREIGN PATENT DOCUMENTS

| | | | |
|---|---|---|---|
| JP | S5922069 | A | 2/1984 |
| JP | 2001-242690 | A | 9/2001 |

(Continued)

OTHER PUBLICATIONS

U.S. Notice of Allowance on U.S. Appl. No. 17/168,449 dated Feb. 4, 2022.

(Continued)

*Primary Examiner* — Sandra Brase
(74) *Attorney, Agent, or Firm* — FOLEY & LARDNER LLP

(57) ABSTRACT

The image forming apparatus includes a developing device, a toner container, a first mechanism, a toner sensor, and a controller. The developing device adheres toner to an electrostatic latent image on a photoconductor to form a toner image. The toner container supplies toner to the developing device. The first mechanism causes a toner interface to undulate in the toner container. The toner sensor detects a capacitance between a first electrode and a second electrode arranged apart from the first electrode. The controller determines a remaining amount of toner in the toner container based on detection information from the toner sensor.

13 Claims, 8 Drawing Sheets

(56) References Cited

U.S. PATENT DOCUMENTS

| | | | |
|---|---|---|---|
| 2007/0206966 | A1 | 9/2007 | Komiya et al. |
| 2011/0170889 | A1 | 7/2011 | Kawai |
| 2016/0097993 | A1 | 4/2016 | Shinohara et al. |
| 2016/0131990 | A1 | 5/2016 | Kanazawa et al. |
| 2016/0223950 | A1 | 8/2016 | Kato et al. |
| 2016/0252874 | A1 | 9/2016 | Fujiwara et al. |
| 2018/0004124 | A1 | 1/2018 | Shibukawa et al. |
| 2019/0235413 | A1 | 8/2019 | Kanno |

FOREIGN PATENT DOCUMENTS

| | | | |
|---|---|---|---|
| JP | 2005-309145 | A | 11/2005 |
| JP | 2010-107978 | A | 5/2010 |

OTHER PUBLICATIONS

U.S. Office Action on U.S. Appl. No. 17/168,449 dated Aug. 3, 2021.

* cited by examiner

IMAGE FORMING APPARATUS AND TONER CARTRIDGE

CROSS-REFERENCE TO RELATED APPLICATION

This application is a continuation of U.S. application Ser. No. 17/168,449 filed Feb. 5, 2021, the entire contents of which are incorporated herein by reference.

FIELD

Embodiments described herein relate generally to an image forming apparatus and a toner cartridge.

BACKGROUND

An image forming apparatus includes a process unit (e.g., a processor) for each color, an exposure device, a transfer mechanism, and a fixing device. The process unit includes a photoconductor, a developing device, and a toner container. The image forming apparatus irradiates a charged and rotating photoconductor with a laser beam by the exposure device based on an image to form an electrostatic latent image on the photoconductor. The image forming apparatus adheres toner to the electrostatic latent image on the photoconductor by the developing device to form a toner image on the photoconductor. The toner container receives toner supply from a toner cartridge and replenishes the toner to the developing device. The image forming apparatus transfers the toner image from the photoconductor on a recording medium such as paper by the transfer mechanism. The image forming apparatus fixes the toner image transferred on the recording medium by the fixing device.

The image forming apparatus detects the presence of toner inside the toner container by a piezoelectric sensor, for instance, provided inside the toner container. However, in order to install the piezoelectric sensor inside the toner container, it is necessary to provide a hole for wiring the piezoelectric sensor in the toner container.

DETAILED DESCRIPTION

In general, according to an embodiment, the image forming apparatus includes a developing device, a toner container, a first mechanism, a remaining toner sensor, and a controller. The developing device adheres toner to the electrostatic latent image on a photoconductor to form a toner image. The toner container supplies toner to the developing device. The first mechanism causes the toner interface to undulate in the toner container. The toner remaining amount sensor detects the capacitance between a first electrode and a second electrode arranged apart from the first electrode. The controller determines the remaining amount of toner in the toner container based on the detection result of the remaining toner sensor.

Hereinafter, an image forming apparatus and a toner cartridge according to an embodiment will be described with reference to the drawings.

First Embodiment

Figure 1:
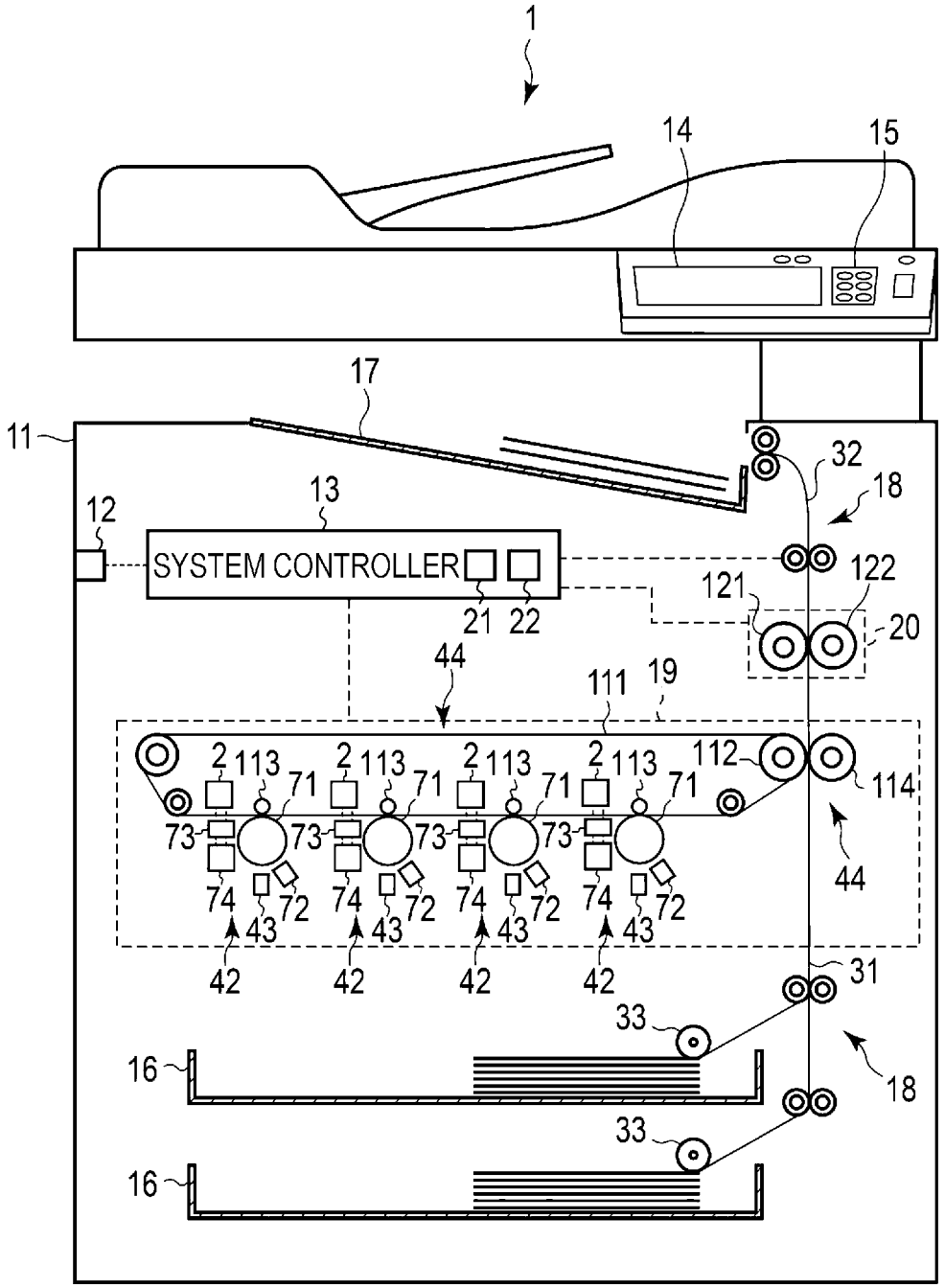
FIG. 1 is a diagram illustrating a configuration of an image forming apparatus, according to an embodiment.

FIG. 1 is an explanatory diagram illustrating a configuration of an image forming apparatus 1 according to an embodiment.

The image forming apparatus 1 is, for example, a multifunction printer (MFP) that performs various processes such as image forming while conveying a recording medium. The image forming apparatus 1 is, for example, a solid-state scanning printer using an LED array, a laser scanning unit (LSU) (e.g., a laser scanner)printer having a polygon mirror, or other printer.

The image forming apparatus 1 forms an image on a recording medium by using the toner replenished from the toner cartridge. The image forming apparatus 1 receives toner from each of a plurality of toner cartridges 2 holding toners of different colors such as cyan, magenta, yellow, and black, and forms a toner image.

As shown in FIG. 1, the image forming apparatus 1 includes a housing 11, a communication interface 12, a system controller 13, a display unit 14 (e.g., a display), an operation interface 15, a sheet supply cassette 16, a sheet discharge tray 17, a conveyance mechanism (conveyor) 18, an image forming unit 19, and a fixing device 20.

The housing 11 is a main body of the image forming apparatus 1. The housing 11 houses the communication interface 12, the system controller 13, the conveyance mechanism 18, the image forming unit 19, and the fixing device 20. The housing 11 is provided with the display unit 14, the operation interface 15, the sheet feed cassette 16, and the sheet discharge tray 17 to be accessible from the outside.

The communication interface 12 is an interface that relays communication with other devices. The communication interface 12 is used for communication, for example, with a client. The client is, for example, an information processing device such as a personal computer, a smartphone, or a tablet PC. The communication interface 12 is configured as, for example, a LAN connector. Further, the communication interface 12 may be configured to perform wireless communication with the client according to a standard such as Bluetooth (registered trademark) or Wi-Fi (registered trademark).

The system controller 13 controls the image forming apparatus 1. The system controller 13 includes, for example, a processor 21 and a memory 22.

The processor 21 is an arithmetic element that executes arithmetic processing. The processor 21 is, for example, a CPU. The processor 21 performs various processes based on data such as a program stored in the memory 22. The processor 21 functions as a control unit (e.g., a controller) configured to execute various operations by executing a program stored in the memory 22.

The memory 22 is a storage medium for storing a program and data used in the program. The memory 22 also functions as a working memory. That is, the memory 22 temporarily stores the data being processed by the processor 21 and the program executed by the processor 21.

The processor 21 performs various information processing by executing a program stored in the memory 22. For example, the processor 21 controls transmission and reception of data by the communication interface 12, screen display by the display unit 14, operation input by the operation interface 15, conveyance of the recording medium by the conveyance mechanism 18, an image forming process by the image forming unit 19, and a fixing process by the fixing device 20. The processor 21 generates a print job based on an image acquired from an external device via the communication interface 12. The processor 21 stores the generated print job in the memory 22.

The print job includes image data indicating an image to be formed on a recording medium. The image data may be data for forming an image on one recording medium or may be data for forming images on a plurality of recording media. The print job contains information indicating whether it is a color print or a monochrome print.

The image forming apparatus 1 may be configured to include an engine controller that controls the conveyance of the recording medium by the conveyance mechanism 18, the image forming process by the image forming unit 19, and the fixing process by the fixing device 20, for instance, separately from the system controller 13. For instance, the system controller 13 supplies the engine controller with information necessary for control by the engine controller.

The display unit 14 includes a display that displays a screen in response to a video signal input from a display control unit (e.g., a display controller) such as the system controller 13 or a graphic controller. For example, the display of the display unit 14 displays screens for various settings of the image forming apparatus 1.

The operation interface 15 includes an operation member that generates an operation signal based on the operation of the user.

The sheet feed cassette 16 is a cassette that accommodates recording media. The sheet supply cassette 16 is configured so that a recording medium can be supplied from the outside of the housing 11. For example, the sheet supply cassette 16 is configured so that the sheet supply cassette 16 can be pulled out from the housing 11.

The sheet discharge tray 17 is a tray that supports the recording medium discharged from the image forming apparatus 1.

The conveyance mechanism 18 is configured to supply a recording medium for printing to the image forming unit 19 and discharge the recording medium on which an image was formed by the image forming unit 19 from the housing. For example, the conveyance mechanism 18 includes a sheet feed conveyance path 31 and a sheet discharge conveyance path 32.

The sheet feed conveyance path 31 and the sheet discharge conveyance path 32 are each configured to include a plurality of motors, a plurality of rollers, and a plurality of guides. The plurality of motors rotate a shaft under the control of the system controller 13 to rotate the rollers linked to the rotation of the shaft. The plurality of rollers move the recording medium by rotating. The plurality of guides control the conveyance direction of the recording medium.

The sheet feed conveyance path 31 takes in the recording medium from the sheet feed cassette 16 and supplies the taken-in recording medium to the image forming unit 19. The sheet feed conveyance path 31 includes a pickup roller 33 corresponding to each sheet supply cassette 16. Each pickup roller 33 takes in the recording medium of the sheet feed cassette 16 into the sheet feed conveyance path 31.

The sheet discharge conveyance path 32 is a conveyance path for discharging the recording medium on which the image was formed from the housing 11. The recording medium discharged by the sheet discharge conveyance path 32 is supported by the sheet discharge tray 17.

Next, the image forming unit 19 will be described.

The image forming unit 19 is configured to form an image on a recording medium. Specifically, the image forming unit 19 forms an image on the recording medium based on the print job generated by the processor 21.

Figure 2:
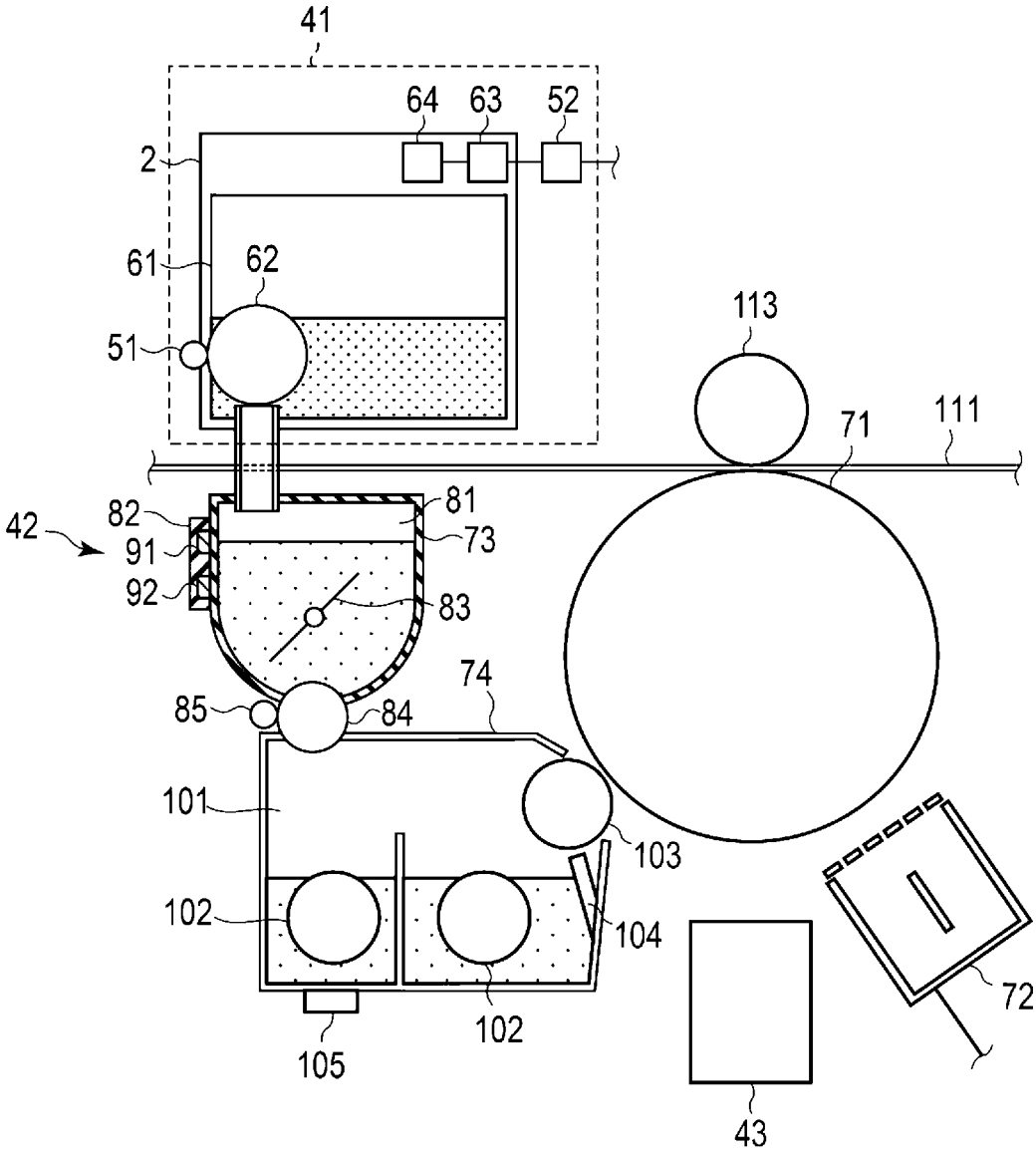
FIG. 2 is a diagram illustrating a configuration around a developing device of the image forming apparatus, according to an embodiment.

FIG. 2 is an explanatory diagram illustrating a partial configuration of the image forming unit 19.

The image forming unit 19 includes a plurality of loading units 41 (e.g., loaders), a plurality of process units 42 (e.g., processors), a plurality of exposure devices 43, and a transfer mechanism 44. The plurality of process units 42 are provided for each type of toner. For example, the plurality of process units 42 correspond to color toners such as cyan, magenta, yellow, and black, respectively. Toner cartridges 2 having toners of different colors are connected to each process unit 42. The loading unit 41 and the exposure device 43 are provided for each process unit 42. For instance, the loading unit 41 and the exposure device 43 are provided for each color such as cyan, magenta, yellow, and black. Since the plurality of loading units 41, the plurality of process units 42, and the plurality of exposure devices 43 each have the same configuration, one process unit 42, one loading unit 41, and one exposure device 43 will be described.

First, the loading unit 41 on which the toner cartridge 2 is mounted will be described.

As shown in FIG. 2, the loading unit 41 is a component in which the toner cartridge 2 filled with toner is mounted. The loading unit 41 includes a space for mounting the toner cartridge 2, a toner replenishment motor 51, and a toner cartridge communication interface 52, respectively.

The toner replenishment motor 51 drives a toner delivery mechanism 62 of the toner cartridge 2 based on the control of the processor 21. When the toner cartridge 2 is loaded in the loading unit 41, the toner replenishment motor 51 is connected to the toner delivery mechanism 62 of the toner cartridge 2. The toner replenishment motor 51 and the toner delivery mechanism 62 of the toner cartridge 2 functions as a toner supply mechanism for supplying toner from the toner cartridge 2 to a sub hopper 73.

The toner cartridge communication interface 52 communicates with the toner cartridge 2. If the toner cartridge 2 is loaded in the loading unit 41, the toner cartridge communication interface 52 is connected to the communication interface of the toner cartridge 2.

Next, the toner cartridge 2 will be described.

As shown in FIG. 2, the toner cartridge 2 includes a toner storage container 61, the toner delivery mechanism 62, a communication interface 63, and an IC chip 64.

The toner storage container 61 is a container for storing toner.

The toner delivery mechanism 62 sends out the toner in the toner storage container 61. The toner delivery mechanism 62 is, for example, a screw provided in the toner storage container 61 and configured to deliver toner by rotating. The toner delivery mechanism 62 is driven by the toner replenishment motor 51. The toner cartridge 2 may be configured to include a motor for rotating the toner delivery mechanism 62.

The communication interface 63 is an interface for communicating with the image forming apparatus 1. The communication interface 63 is connected to the toner cartridge communication interface 52 if the toner cartridge 2 is mounted on the loading unit 41.

The IC chip 64 includes a memory that stores various control data in advance and a processor. The control data is, for example, an "identification code" and a "near empty threshold". The "identification code" indicates the type and model number of the toner cartridge 2. The "near empty threshold" is a threshold for causing the image forming apparatus 1 to determine whether the remaining amount of toner in the toner cartridge 2 is low.

Next, a plurality of process units 42 (e.g., processors) will be described.

The process unit 42 is configured to form a toner image. The process unit 42 includes a photosensitive drum 71, a charger 72, the sub hopper 73, and a developing device 74.

The photosensitive drum 71 is a photoconductor including a cylindrical drum and a photosensitive layer formed on the outer peripheral surface of the drum. The photosensitive drum 71 rotates at a constant speed.

The charging charger 72 uniformly charges the surface of the photosensitive drum 71. For example, the charger 72 charges the photosensitive drum 71 to a uniform negative electrode potential by applying a voltage to the photosensitive drum 71 using a charging roller. The charging roller is rotated by the rotation of the photosensitive drum 71 in a state where a predetermined pressure is applied to the photosensitive drum 71.

The sub hopper 73 is a toner container that receives toner from the toner cartridge 2 and stores the received toner. The sub hopper 73 supplies the toner to the developing device 74. The sub hopper 73 includes a toner storage container 81, a remaining toner sensor 82, a stirring mechanism 83, a toner delivery mechanism 84, and a toner replenishment motor 85. In FIG. 2, the toner storage container 81 and the remaining toner sensor 82 of the sub hopper 73 are shown as cross sections.

The toner storage container 81 is a container for storing the toner received from the toner cartridge 2. The toner storage container 81 is made of resin.

The remaining toner sensor 82 is a sensor that detects the remaining amount of toner within the toner storage container 81. The remaining toner sensor 82 is, for example, a capacitance sensor.

The remaining toner sensor 82 includes a first electrode 91 arranged in the toner storage container 81, and a second electrode 92 provided below the first electrode 91 in the vertical direction. The first electrode 91 and the second electrode 92 are provided on the outer wall surface of the toner storage container 81. For example, the first electrode 91 and the second electrode 92 are provided to be in contact with the outer wall surface of the toner storage container 81. The first electrode 91 and the second electrode 92 are formed as a wiring pattern on, for example, a resin substrate. The remaining toner sensor 82 detects the capacitance between the first electrode 91 and the second electrode 92. The remaining toner sensor 82 transmits a signal corresponding to the change in capacitance between the first electrode 91 and the second electrode 92 to the system controller 13 as a detection result.

The stirring mechanism 83 has a configuration to stir the toner in the toner storage container 81. The stirring mechanism 83 includes a paddle for stirring in the toner storage container 81. The stirring mechanism 83 stirs the toner in the toner storage container 81 by rotating the paddle. The stirring mechanism 83 is configured to undulate the interface of the toner by stirring the toner in the toner storage container 81.

The toner delivery mechanism 84 sends out the toner in the toner storage container 81 to the developing device 74. The toner delivery mechanism 84 is, for example, a screw provided in the toner storage container 81 and delivering toner by rotating. The toner delivery mechanism 84 is driven by the toner replenishment motor 85.

The toner replenishment motor 85 drives the toner delivery mechanism 84 under the control of the processor 21. The toner replenishment motor 85 drives the toner delivery mechanism 84 to supply the toner in the toner storage container 81 to the developing device 74. The toner replenishment motor 85 and the toner delivery mechanism 84 function as a toner supply mechanism for supplying toner from the sub hopper 73 to the developing device 74.

The developing device 74 is a device for adhering toner to the photosensitive drum 71. The developing device 74 includes a developer container 101, a stirring mechanism 102, a developing roller 103, a doctor blade 104, and an auto toner control (ATC) sensor 105.

The developer container 101 is a container that stores a developer containing toner and a carrier. The developer container 101 receives the toner delivered from the toner storage container 81 of the sub hopper 73 by the toner delivery mechanism 84 of the sub hopper 73. The carrier is stored in the developer container 101 at the time of manufacturing the developing device 74.

The stirring mechanism 102 rotates to stir the toner and the carrier in the developer container 101. The stirring mechanism 102 is, for example, an auger screw.

The developing roller 103 rotates in the developer container 101 to adhere the developer to the surface thereof.

The doctor blade 104 is a member arranged at a predetermined distance from the surface of the developing roller 103. The doctor blade 104 removes a part of the developer adhering to the surface of the rotating developing roller 103. As a result, a layer of the developer having a thickness corresponding to the distance between the doctor blade 104 and the surface of the developing roller 103 is formed on the surface of the developing roller 103.

The ATC sensor 105 is, for example, a magnetic flux sensor including a coil and detecting a voltage value generated in the coil. The detected voltage of the ATC sensor 105 changes depending on the density of the magnetic flux from the toner in the developer container 101. That is, the system controller 13 can determine the toner concentration ratio of the toner remaining in the developer container 101 to the carrier based on the detected voltage of the ATC sensor 105.

The processor 21 of the system controller 13 controls the toner supply based on the toner concentration ratio in the developer container 101. For example, if it is determined that the toner concentration ratio in the developer container 101 is less than the threshold, the processor 21 determines that the remaining amount of toner in the developer container 101 is insufficient. If it is determined that the toner concentration ratio in the developer container 101 is less than the threshold, the processor 21 operates the toner replenishment motor 85 by a predetermined amount. If the toner replenishment motor 85 operates, the toner delivery mechanism 84 of the sub hopper 73 is driven and the toner in the toner storage container 81 is delivered to the developer container 101 of the developing device 74. As a result, toner is replenished from the sub hopper 73 to the developing device 74.

Next, the exposure device 43 will be described.

The exposure device 43 includes a plurality of light emitting elements. The exposure device 43 forms a latent image on the photosensitive drum 71 by irradiating the charged photosensitive drum 71 with light from the light emitting element. The light emitting element is, for example, a light emitting diode (LED). One light emitting element is configured to irradiate one point on the photosensitive drum 71 with light. The plurality of light emitting elements are arranged in a main scanning direction, which is a direction parallel to the rotation axis of the photosensitive drum 71.

The exposure device 43 forms a latent image for one line on the photosensitive drum 71 by irradiating the photosensitive drum 71 with light by the plurality of light emitting elements arranged in the main scanning direction. The exposure device 43 forms a latent image of a plurality of lines by continuously irradiating the rotating photosensitive drum 71 with light.

In the above configuration, if the surface of the photosensitive drum 71 charged by the charger 72 is irradiated with light from the exposure device 43, an electrostatic latent image is formed. If the layer of the developer formed on the surface of the developing roller 103 is close to the surface of the photosensitive drum 71, the toner contained in the developer adheres to the latent image formed on the surface of the photosensitive drum 71. As a result, a toner image is formed on the surface of the photosensitive drum 71.

Next, the transfer mechanism 44 will be described.

The transfer mechanism 44 has a configuration to transfer the toner image from the surface of the photosensitive drum 71 on a recording medium. The transfer mechanism 44 includes, for example, a primary transfer belt 111, a secondary transfer counter roller 112, a plurality of primary transfer rollers 113, and a secondary transfer roller 114.

The primary transfer belt 111 is an endless belt wound around the secondary transfer counter roller 112 and a plurality of winding rollers. In the primary transfer belt 111, the inner surface (inner peripheral surface) is in contact with the secondary transfer counter roller 112 and the plurality of winding rollers, and the outer surface (outer peripheral surface) is opposed to the photosensitive drum 71 of the process unit 42.

The secondary transfer counter roller 112 is rotated by a motor (not shown). The secondary transfer counter roller 112 rotates to convey the primary transfer belt 111 in a predetermined conveyance direction. The plurality of winding rollers are configured to be freely rotatable. The plurality of winding rollers rotate according to the movement of the primary transfer belt 111 by the secondary transfer counter roller 112.

The plurality of primary transfer rollers 113 are configured to bring the primary transfer belt 111 into contact with the photosensitive drums 71 of the plurality of process units 42, respectively. The plurality of primary transfer rollers 113 are provided to correspond to the photosensitive drums 71 of the plurality of process units 42. Specifically, the plurality of primary transfer rollers 113 are provided at positions each facing the photosensitive drum 71 of the corresponding process unit 42 with the primary transfer belt 111 interposed therebetween. The primary transfer roller 113 contacts the inner peripheral surface side of the primary transfer belt 111 and displaces the primary transfer belt 111 toward the photosensitive drum 71 side. As a result, the primary transfer roller 113 brings the outer peripheral surface of the primary transfer belt 111 into contact with the photosensitive drum 71.

The secondary transfer roller 114 is provided at a position facing the primary transfer belt 111. The secondary transfer roller 114 contacts the outer peripheral surface of the primary transfer belt 111 and applies pressure. As a result, a transfer nip is formed in which the secondary transfer roller 114 and the outer peripheral surface of the primary transfer belt 111 are in close contact with each other. If the recording medium passes through the transfer nip, the secondary transfer roller 114 presses the recording medium passing through the transfer nip against the outer peripheral surface of the primary transfer belt 111.

The secondary transfer roller 114 and the secondary transfer counter roller 112 rotate to convey the recording medium supplied from the sheet feed cassette 16 by the conveyance mechanism 18 in a sandwiched state. As a result, the recording medium passes through the transfer nip.

In the above configuration, if the outer peripheral surface of the primary transfer belt 111 comes into contact with the photosensitive drum 71, the toner image formed on the surface of the photosensitive drum 71 is transferred on the outer peripheral surface of the primary transfer belt 111. If the image forming unit 19 includes a plurality of process units 42, the primary transfer belt 111 receives toner images from the photosensitive drums 71 of the plurality of process units 42. The toner image transferred on the outer peripheral surface of the primary transfer belt 111 is conveyed by the primary transfer belt 111 to the transfer nip in which the secondary transfer roller 114 and the outer peripheral surface of the primary transfer belt 111 are in close contact with each other. If a recording medium is present in the transfer nip, the toner image on the outer peripheral surface of the primary transfer belt 111 is transferred on the recording medium in the transfer nip.

Next, the configuration related to the fixing of the image forming apparatus 1 will be described.

The fixing device 20 melts the toner transferred to the recording medium and fixes the toner image. The fixing device 20 operates under the control of the system controller 13. The fixing device 20 includes a heating member that applies heat to the recording medium and a pressurizing member that applies pressure to the recording medium. For example, the heating member is, for example, a heat roller 121. For example, the pressurizing member is a press roller 122.

The heat roller 121 is a rotating body for fixing and is rotated by a motor (not shown). The heat roller 121 includes a core metal formed of hollow metal and an elastic layer formed on the outer periphery of the core metal. The heat roller 121 is heated to a high temperature by a heater arranged inside the core metal formed in a hollow shape. The heater is, for example, a halogen heater. The heater may be an induction heating (IH) heater that heats the core metal by electromagnetic induction.

The press roller 122 is provided at a position facing the heat roller 121. The press roller 122 includes a core metal formed of metal having a predetermined outer diameter and an elastic layer formed on the outer periphery of the core metal. The press roller 122 applies pressure to the heat roller 121 by the stress applied from the tension member. If pressure is applied from the press roller 122 to the heat roller 121, a fixing nip in which the press roller 122 and the heat roller 121 are in close contact with each other is formed. By rotating, the press roller 122 moves the recording medium that entered the fixing nip and presses the recording medium against the heat roller 121.

With the above configuration, the heat roller 121 and the press roller 122 apply heat and pressure to the recording medium passing through the fixing nip. As a result, the toner image is fixed on the recording medium that passed through the fixing nip. The recording medium that passed through the fixing nip is discharged to the outside of the housing 11 by the conveyance mechanism 18. The fixing device 20 is not limited to the above configuration. The fixing device 20 may be configured by an on-demand method in which heat is applied to a recording medium on which a toner image was transferred via a film-like member to melt and fix the toner.

Next, the remaining toner sensor 82 provided in the sub hopper 73 of the process unit 42 will be described in detail.

Figure 3:
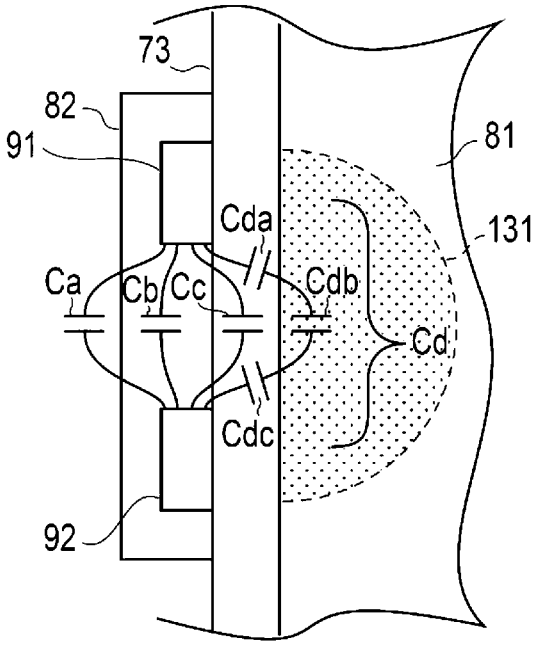
FIG. 3 is a diagram illustrating a remaining toner sensor provided in a toner storage container of the image forming apparatus, according to an embodiment.

FIG. 3 is an explanatory diagram for illustrating the detection range 131 of the remaining toner sensor 82.

As shown in FIG. 3, the capacitance between the first electrode 91 and the second electrode 92 is the sum of a capacitance Ca, a capacitance Cb, a capacitance Cc, and a capacitance Cd.

The capacitance Ca is the capacitance of the space opposite to the side where the toner is stored in the toner storage container 81 of the sub hopper 73. That is, the capacitance Ca is the capacitance in the range including the space outside the toner storage container 81 between the first electrode 91 and the second electrode 92.

The capacitance Cb is the capacitance inside the substrate of the remaining toner sensor 82. That is, the capacitance Cb is the capacitance in the range inside the substrate of the remaining toner sensor 82 between the first electrode 91 and the second electrode 92.

The capacitance Cc is the capacitance inside the outer wall of the toner storage container 81 of the sub hopper 73. That is, the capacitance Cc is the capacitance in the range inside the resin outer wall of the toner storage container 81 of the sub hopper 73 between the first electrode 91 and the second electrode 92.

The capacitance Cd is the capacitance inside the toner storage container 81 of the sub hopper 73. That is, the capacitance Cd is the capacitance in the range including the space inside the toner storage container 81 of the sub hopper 73 between the first electrode 91 and the second electrode 92. The capacitance Cd can be decomposed into a capacitance Cda, a capacitance Cdb, and a capacitance Cdc.

The capacitance Cda and the capacitance Cdc are the capacitances in the range inside the resin outer wall of the toner storage container 81 of the sub-hopper 73 between the first electrode 91 and the second electrode 92.

The capacitance Cdb is the capacitance of the space inside the toner storage container 81 of the sub hopper 73. That is, the capacitance Cdb is the capacitance of the space inside the toner storage container 81 of the sub hopper 73 between the first electrode 91 and the second electrode 92.

The capacitance Ca, the capacitance Cb, and the capacitance Cc do not change depending on the remaining amount of toner in the toner storage container 81. The capacitance Cda and the capacitance Cdc do not change depending on the remaining amount of toner in the toner storage container 81.

On the other hand, the capacitance Cdb changes as the toner flows in and out of the space inside the toner storage container 81 of the sub hopper 73. That is, the detection range 131 of the remaining toner sensor 82 is a range in which the capacitance Cdb changes if toner flows in and out of the toner storage container 81 of the sub hopper 73. Specifically, the detection range 131 of the remaining toner sensor 82 is a space in the toner storage container 81 of the sub hopper 73 and in the vicinity of the first electrode 91 and the second electrode 92.

The capacitance Cdb is replaced with a parallel plate capacitor model. It is assumed that the distance between the electrodes of the parallel plate capacitor is d and the flat plate area of the parallel plate capacitor is S. It is assumed that the relative dielectric constant of the toner is $\varepsilon r$ and the relative dielectric constant of the space is $\varepsilon 0$. Here, the capacitance Cdb if there is toner is in the detection range 131 is $Cdb=\varepsilon r\cdot\varepsilon 0\cdot(S/d)$ [F]. Here, the capacitance Cdb if there is no toner in the detection range 131 is $Cdb=\varepsilon 0\cdot(S/d)$ [F].

Next, the behavior of the toner in the toner storage container 81 of the sub hopper 73 will be described.

Figure 4:
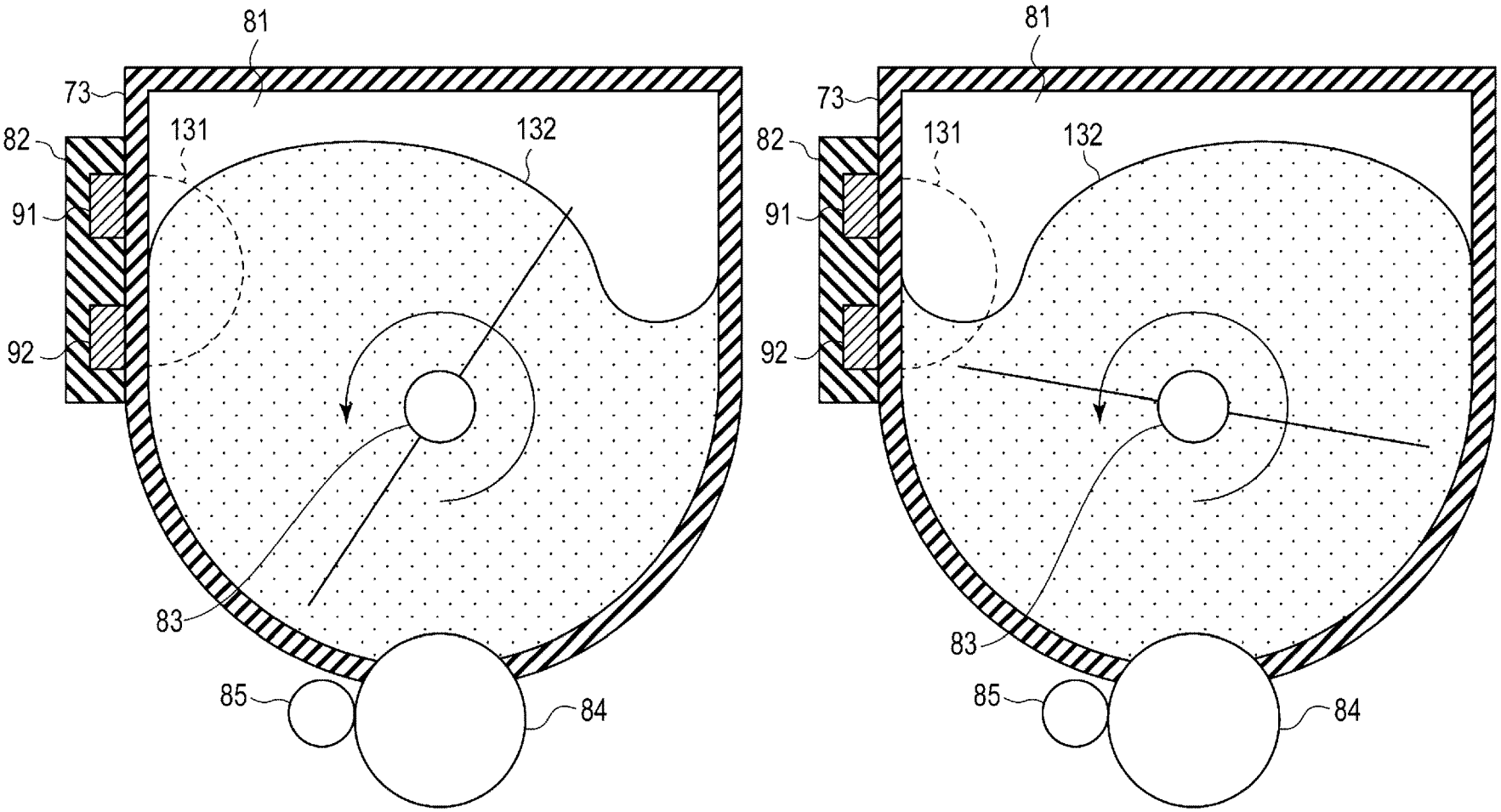
FIG. 4 is an explanatory diagram illustrating a toner behavior inside the toner container, according to an embodiment.
Figure 5:
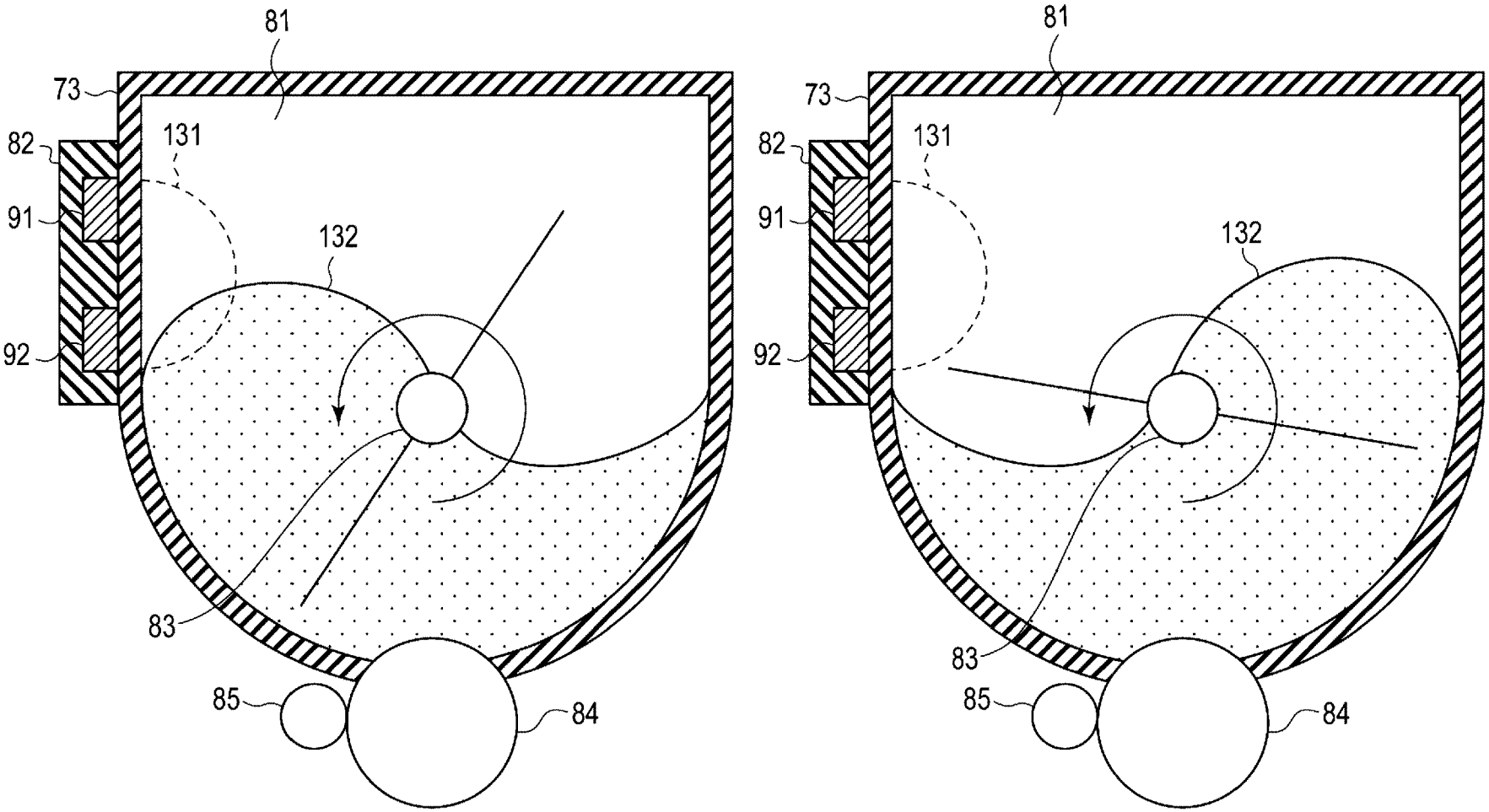
FIG. 5 is an explanatory diagram illustrating a toner behavior inside the toner container, according to an embodiment.
Figure 6:
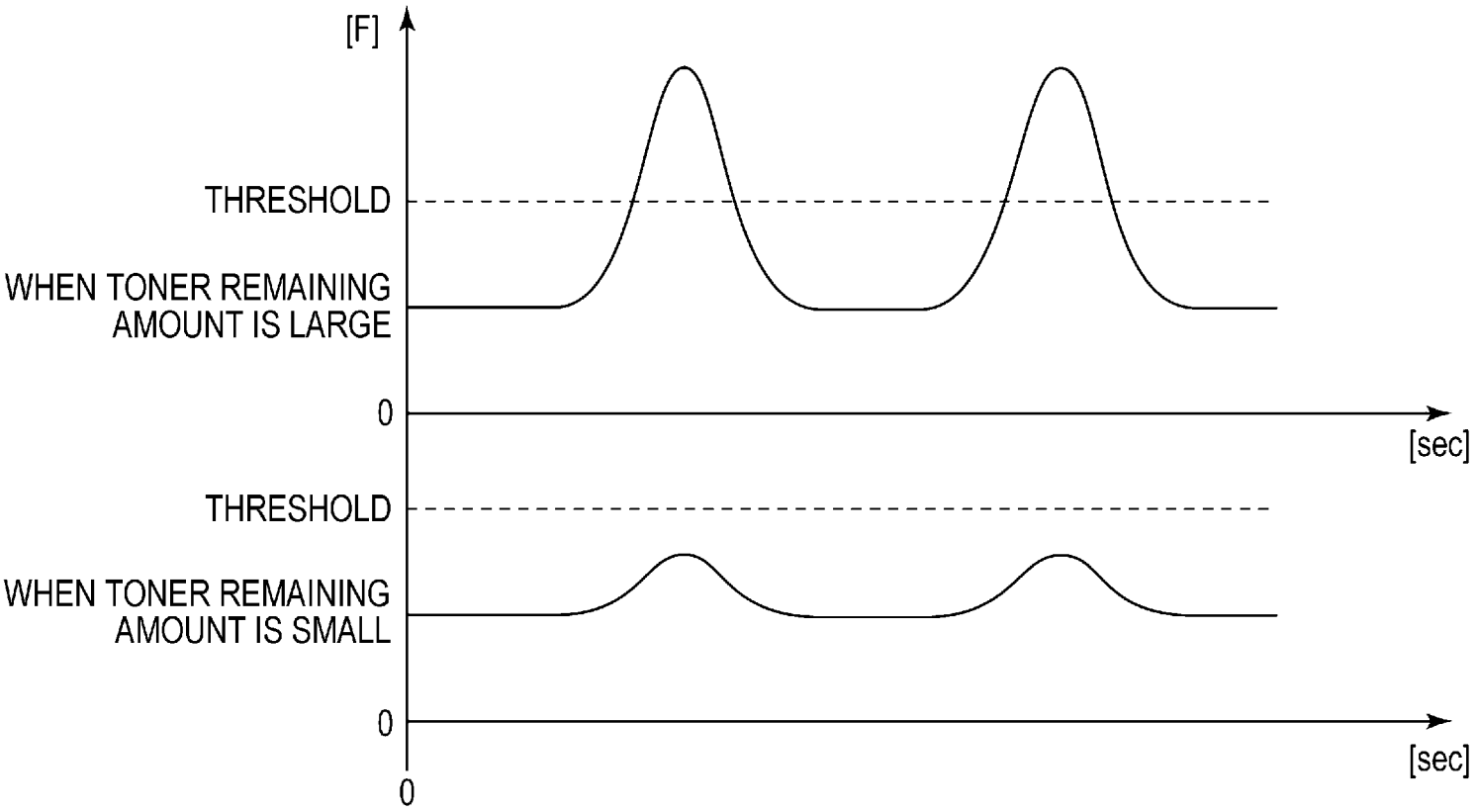
FIG. 6 is a diagram illustrating a detection result of the toner remaining amount sensor, according to an embodiment.

FIG. 4 is an explanatory diagram illustrating the behavior of the toner if the remaining amount of toner in the toner storage container 81 of the sub hopper 73 is large, according to an embodiment. FIG. 5 is an explanatory diagram illustrating the behavior of the toner if the remaining amount of the toner in the toner storage container 81 of the sub hopper 73 is small, according to an embodiment. FIG. 6 is an explanatory diagram showing an absolute value of the amount of change in capacitance detected by the remaining toner sensor 82, according to an embodiment. The vertical axis of FIG. 6 represents the absolute value of the amount of change in capacitance. The horizontal axis of FIG. 6 represents time.

As shown in FIGS. 4 and 5, the operation of the stirring paddle of the stirring mechanism 83 causes a toner interface 132 to have a wavy shape in the toner storage container 81. The toner interface 132 is a boundary between the toner filled in the toner container 81 and the space in the toner container 81. The amount of toner between the first electrode 91 and the second electrode 92 changes due to the undulation of the toner interface 132. That is, the toner flows in and out of the detection range 131 of the remaining toner sensor 82.

As described above, if the toner flows in and out of the detection range 131 of the remaining toner sensor 82, the capacitance Cdb between the first electrode 91 and the second electrode 92 changes, and a change in the detection result of the remaining toner sensor 82 appears. The change appearing in the detection result of the remaining toner sensor 82 increases or decreases according to the amount of toner flowing in and out of the detection range 131.

As shown in FIG. 4, if the toner interface 132 undulates in a state where the remaining amount of toner in the toner storage container 81 of the sub hopper 73 is large, a large amount of toner flows in and out of the detection range 131 of the remaining toner sensor 82. In other words, if the toner interface 132 undulates if the toner interface 132 is close to the first electrode 91 and the second electrode 92 of the remaining toner sensor 82, the amount of toner flowing in and out of the detection range 131 of the remaining toner sensor 82 increases. As described above, if the amount of toner flowing in and out of the detection range 131 of the remaining toner sensor 82 increases, the absolute value of the change amount appearing in the detection result of the remaining toner sensor 82 becomes large.

As shown in FIG. 5, if the toner interface 132 undulates in a state where the remaining amount of toner in the toner storage container 81 of the sub hopper 73 is low, a small amount of toner flows in and out of the detection range 131 of the remaining toner sensor 82. In other words, if the toner interface 132 undulates if the toner interface 132 is far from the first electrode 91 and the second electrode 92 of the remaining toner sensor 82, the amount of toner flowing in and out of the detection range 131 of the remaining toner sensor 82 decreases. As described above, if the amount of toner flowing in and out of the detection range 131 of the remaining toner sensor 82 decreases, the absolute value of the change amount appearing in the detection result of the remaining toner sensor 82 becomes small.

If the remaining amount of toner in the toner storage container 81 is smaller than that in the example of FIG. 5, the toner does not flow in and out of the detection range 131 of the remaining toner sensor 82. Here, even if the toner interface 132 undulates, the toner does not flow in and out of the detection range 131 of the remaining toner sensor 82 and the detection result of the remaining toner sensor 82 does not change.

FIG. 6 shows the detection result of the remaining toner sensor 82 if the remaining amount of toner in the toner containing container 81 is large and the detection result of the remaining toner sensor 82 if the remaining amount of toner in the toner containing container 81 is small. When the remaining amount of toner is large, the amount of toner flowing in and out of the detection range 131 of the remaining toner sensor 82 is larger than when the remaining amount of toner is small. Therefore, when the remaining amount of toner is large, the absolute value of the amount of change in capacitance detected by the remaining toner sensor 82 becomes larger than when the remaining amount of toner is small. That is, the amount of change appearing in the detection result of the remaining toner sensor 82 increases or decreases depending on the position of the toner interface 132 with respect to the first electrode 91 and the second electrode 92.

In the processor 21 of the system controller 13, if the capacitance changes significantly while the toner interface 132 undulates, it is possible to determine that the toner interface 132 exists at a position close to the first electrode 91 and the second electrode of the remaining toner sensor 82. The processor 21 can determine that the toner interface 132 exists at a position far from the first electrode 91 and the second electrode of the remaining toner sensor 82 if the change in capacitance while the toner interface 132 undulates is small.

The processor 21 of the system controller 13 determines the remaining amount of toner in the toner storage container 81 based on the detection result of the remaining toner sensor 82. The processor 21 determines the remaining amount of toner in the toner storage container 81 based on the temporal change of the capacitance between the first electrode 91 and the second electrode 92 while the toner interface 132 undulates by the stirring mechanism 83.

For example, the processor 21 compares the threshold with the absolute value of the amount of change in capacitance detected by the remaining toner sensor 82. Based on the comparison result, the processor 21 determines whether the remaining amount of toner in the toner storage container 81 of the sub hopper 73 is sufficient.

That is, if the absolute value of the amount of change in capacitance between the first electrode 91 and the second electrode 92 while the toner interface 132 undulates is larger than the threshold, the processor 21 determines that the remaining amount of toner in the toner storage container 81 is sufficient.

If the absolute value of the amount of change in capacitance between the first electrode 91 and the second electrode 92 while the toner interface 132 undulates is smaller than the threshold, the processor 21 determines that the remaining amount of toner in the toner storage container 81 is insufficient.

The processor 21 controls the toner replenishment based on the determination of the remaining amount of toner in the toner storage container 81. For example, if the processor 21 determines that the remaining amount of toner in the toner storage container 81 is insufficient, the processor 21 operates the toner replenishment motor 51 by a predetermined amount. If the toner replenishment motor 51 operates, the toner delivery mechanism 62 of the toner cartridge 2 is driven and the toner in the toner storage container 61 is delivered to the toner storage container 81 of the sub hopper 73. As a result, toner is replenished from the toner cartridge 2 to the sub hopper 73.

As described above, the processor 21 of the system controller 13 of the image forming apparatus 1 acquires the change in capacitance while the toner interface 132 undulates by the stirring mechanism 83 in the toner storage container 81 from the capacitance sensor provided on the outer wall surface of the toner storage container 81.

If the change in capacitance is large, the processor 21 determines that the toner interface 132 exists in the vicinity of the detection range 131 of the capacitance sensor in the toner storage container 81. If the change in capacitance is small, the processor 21 determines that the toner interface 132 exists at a position far from the detection range 131 of the capacitance sensor in the toner storage container 81. That is, the processor 21 can determine the position of the toner interface 132 with respect to the detection range 131 of the capacitance sensor. As a result, the processor 21 can determine whether the remaining amount of toner in the toner storage container 81 is sufficient.

As such, the processor 21 can determine whether the remaining amount of toner in the toner storage container 81 is sufficient based on the detection result of the capacitance sensor provided on the outer wall surface of the toner storage container 81. As a result, the image forming apparatus 1 can determine whether the remaining amount of toner in the toner storage container 81 is sufficient without making a hole in the toner storage container 81.

The processor 21 can determine whether the remaining amount of toner in the toner storage container 81 is sufficient based on the change in the amount of toner in the detection range 131 of the capacitance sensor caused by stirring. As a result, the image forming apparatus 1 can determine whether the remaining amount of toner in the toner container 81 is sufficient without considering environmental conditions.

For example, even when the sub hopper 73 is filled with toner until the toner interface 132 rises to a position as high as the detection range 131 of the remaining toner sensor 82, the amount of change in capacitance becomes small. Here, the processor 21 may be configured to determine the remaining amount of toner after a certain amount or more of toner is delivered from the sub hopper 73 to the developing device 74.

The processor 21 continuously acquires the detection result of the remaining toner sensor 82. As a result, the processor 21 can determine whether the toner is replenished from the toner cartridge 2 to the sub hopper 73, and the toner interface 132 rises above the second electrode 92 and the first electrode 91 in the vertical direction. If the processor 21 determines that the toner interface 132 rises above the second electrode 92 and the first electrode 91 in the vertical direction, the toner replenishment motor 85 operates by a predetermined amount or more, and then the processor 21 determines the remaining amount of toner based on the detection result of the remaining toner sensor 82. That is, the processor 21 determines the remaining amount of toner in the storage container 81 based on the detection result of the remaining toner sensor 82 if the toner is filled in the toner storage container 81 to a position higher than the first electrode 91 and then the toner is discharged in a predetermined amount or more.

In the embodiment, the first electrode 91 and the second electrode 92 are provided on the outer wall surface of the toner storage container 81 but the configuration is not limited thereto. The first electrode 91 and the second electrode 92 only need to be arranged at least apart from each other, and the first electrode 91 and the second electrode 92 may be separately arranged on the side surface and the bottom surface of the toner storage container 81.

The first electrode 91 and the second electrode 92 may be configured as needle electrodes that are pierced from the outside to the inside of the toner storage container 81.

Either the first electrode 91 or the second electrode 92 may be a sensing electrode and the other may be a GND electrode.

The remaining toner sensor 82 may be configured to detect the capacitance between one sensing electrode and a plurality of GND electrodes.

In the embodiment, the processor 21 of the system controller 13 of the image forming apparatus 1 acquires the change in capacitance while stirring the inside of the toner storage container 81 with the stirring mechanism 83 from the capacitance sensor provided on the outer wall surface of the toner storage container 81 but the configuration is not limited thereto. The processor 21 can determine the remaining amount of toner based on the detection result of the remaining amount sensor 82 as long as the toner interface 132 at least undulates in the toner storage container 81. That is, the stirring mechanism 83 may be replaced with a mechanism that causes the toner interface 132 to undulate in the toner storage container 81.

Second Embodiment

The image forming apparatus 1 according to a second embodiment will be described. The image forming apparatus 1 according to the second embodiment has a different configuration of the process unit 42 of the image forming unit 19 from the first embodiment. The image forming unit 19 of the second embodiment is different in that the developing device 74 and the toner cartridge 2 are also provided with a remaining toner sensor and the toner cartridge 2 is further provided with a stirring mechanism. The process unit of the second embodiment is referred to as a process unit 151 (e.g., a processor). The toner cartridge of the second embodiment is referred to as a toner cartridge 152.

Figure 7:
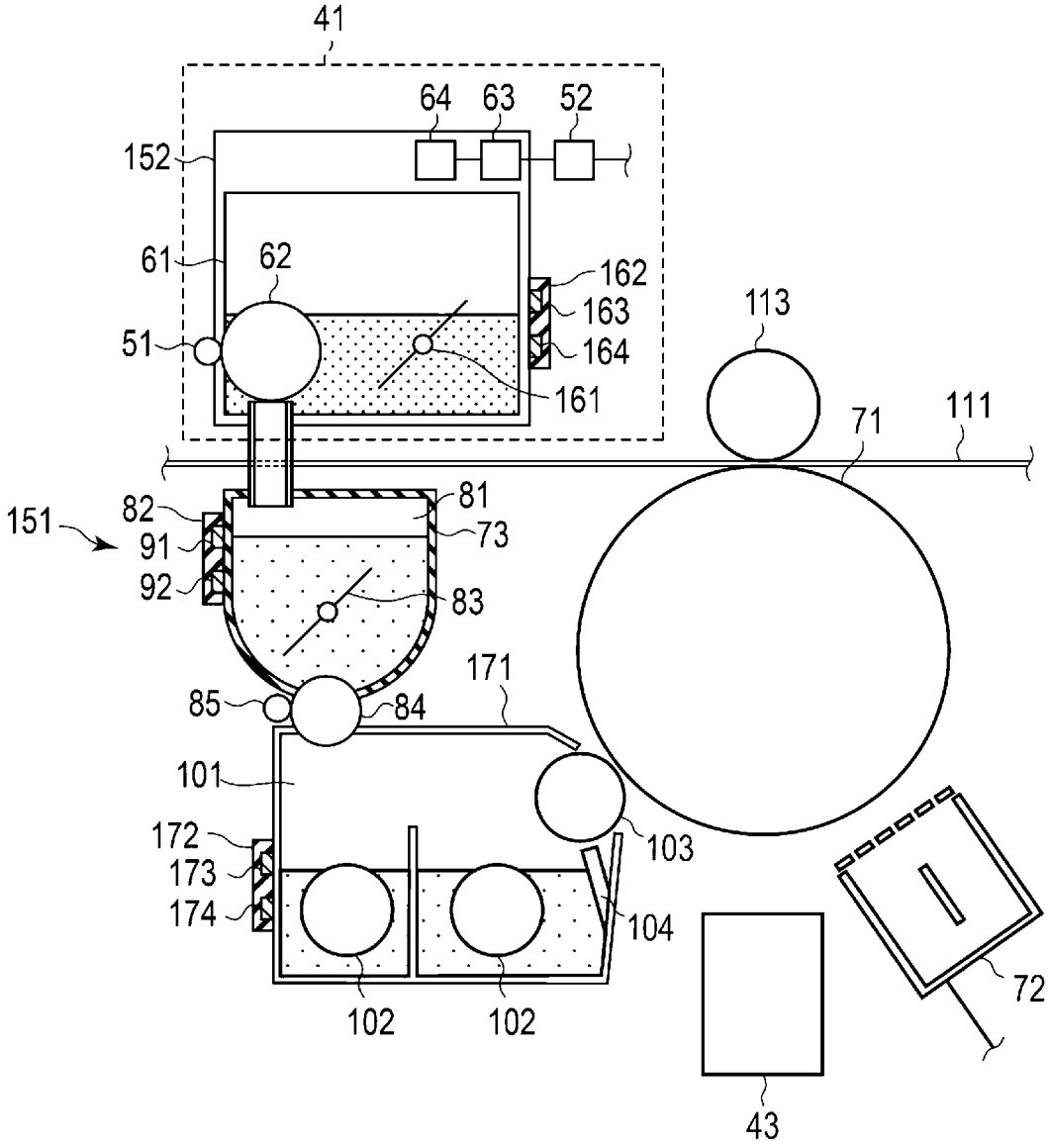
FIG. 7 is a diagram illustrating a configuration around a developing device of an image forming apparatus according to a second embodiment, according to an embodiment.

FIG. 7 is an explanatory diagram illustrating an example configuration of the process unit 151 of the second embodiment. The same reference numerals are denoted to the same configurations as those in the first embodiment and the detailed descriptions thereof will be omitted.

First, the toner cartridge 152 will be described.

As shown in FIG. 7, the toner cartridge 152 includes the toner storage container 61, the toner delivery mechanism 62, the communication interface 63, the IC chip 64, a stirring mechanism 161, and a remaining toner sensor 162.

The stirring mechanism 161 is configured to stir the toner in the toner storage container 61. The stirring mechanism 161 includes a paddle for stirring in the toner storage container 61. The stirring mechanism 161 stirs the toner in the toner storage container 61 by rotating the paddle.

The remaining toner sensor 162 is a sensor that detects the remaining amount of toner in the toner storage container 61. The remaining toner sensor 162 is, for example, a capacitance sensor.

The remaining toner sensor 162 includes a first electrode 163 arranged in the toner storage container 61, and a second electrode 164 provided below the first electrode 163 in the vertical direction. The first electrode 163 and the second electrode 164 are provided on the outer wall surface of the toner storage container 61. For example, the first electrode 163 and the second electrode 164 are provided to be in contact with the outer wall surface of the toner storage container 61. The first electrode 163 and the second electrode 164 are formed as a wiring pattern on, for example, a resin substrate. The remaining toner sensor 162 detects the capacitance between the first electrode 163 and the second electrode 164. The remaining toner sensor 162 transmits a signal corresponding to the change in capacitance between the first electrode 163 and the second electrode 164 to the system controller 13 as a detection result.

The processor 21 of the system controller 13 can determine the position of the toner interface in the toner storage container 61 with respect to the first electrode 163 and the second electrode 164 based on the detection result of the remaining toner sensor 162. As a result, the processor 21 can determine whether the remaining amount of toner in the toner storage container 61 is insufficient.

The processor 21 can output a near-out-of-toner notification based on the determination result of whether the remaining amount of toner in the toner storage container 61 is insufficient. The processor 21 may be configured to determine whether the toner is out based on the determination result of whether the remaining amount of toner in the toner storage container 61 is insufficient.

Next, the process unit 151 will be described.

As shown in FIG. 7, the process unit 151 includes the photosensitive drum 71, the charger 72, the sub hopper 73, and a developing device 171.

The developing device 171 includes the developer container 101, the stirring mechanism 102, the developing roller 103, the doctor blade 104, and a remaining toner sensor 172.

The remaining toner sensor 172 is a sensor that detects the remaining amount of toner in the developer container 101. The remaining toner sensor 172 is, for example, a capacitance sensor.

The remaining toner sensor 172 includes a first electrode 173 arranged in the developer container 101, and a second electrode 174 provided below the first electrode 173 in the vertical direction. The first electrode 173 and the second electrode 174 are provided on the outer wall surface of the developer container 101. For example, the first electrode 173 and the second electrode 174 are provided to be in contact with the outer wall surface of the developer container 101. The first electrode 173 and the second electrode 174 are formed as a wiring pattern on, for example, a resin substrate. The remaining toner sensor 172 detects the capacitance between the first electrode 173 and the second electrode 174. The remaining toner sensor 172 transmits a signal corresponding to the change in capacitance between the first electrode 163 and the second electrode 164 to the system controller 13 as information in the form of a detection result.

The processor 21 of the system controller 13 can determine the position of the toner interface in the developer container 101 with respect to the first electrode 173 and the second electrode 174 based on the detection result of the remaining toner sensor 172. As a result, the processor 21 can determine whether the remaining amount of toner in the developer container 101 is insufficient.

The processor 21 can operate the toner replenishment motor 85 based on the determination result of whether the remaining amount of toner in the developer container 101 is insufficient. If the processor 21 determines that the remaining amount of toner in the developer container 101 is insufficient, the processor 21 operates the toner replenishment motor 85 by a predetermined amount. If the toner replenishment motor 85 operates, the toner delivery mechanism 84 of the sub hopper 73 is driven and the toner in the toner storage container 81 is delivered to the developer container 101 of the developing device 74. As a result, toner is replenished from the sub hopper 73 to the developing device 74.

In the embodiment, the stirring mechanism 83 stirs the toner in the toner storage container 81 to undulate the toner interface 132, but the configuration is not limited thereto. In the toner storage container 81, a mechanism for undulating the toner interface 132 may be added separately from the stirring mechanism 83.

Figure 8:
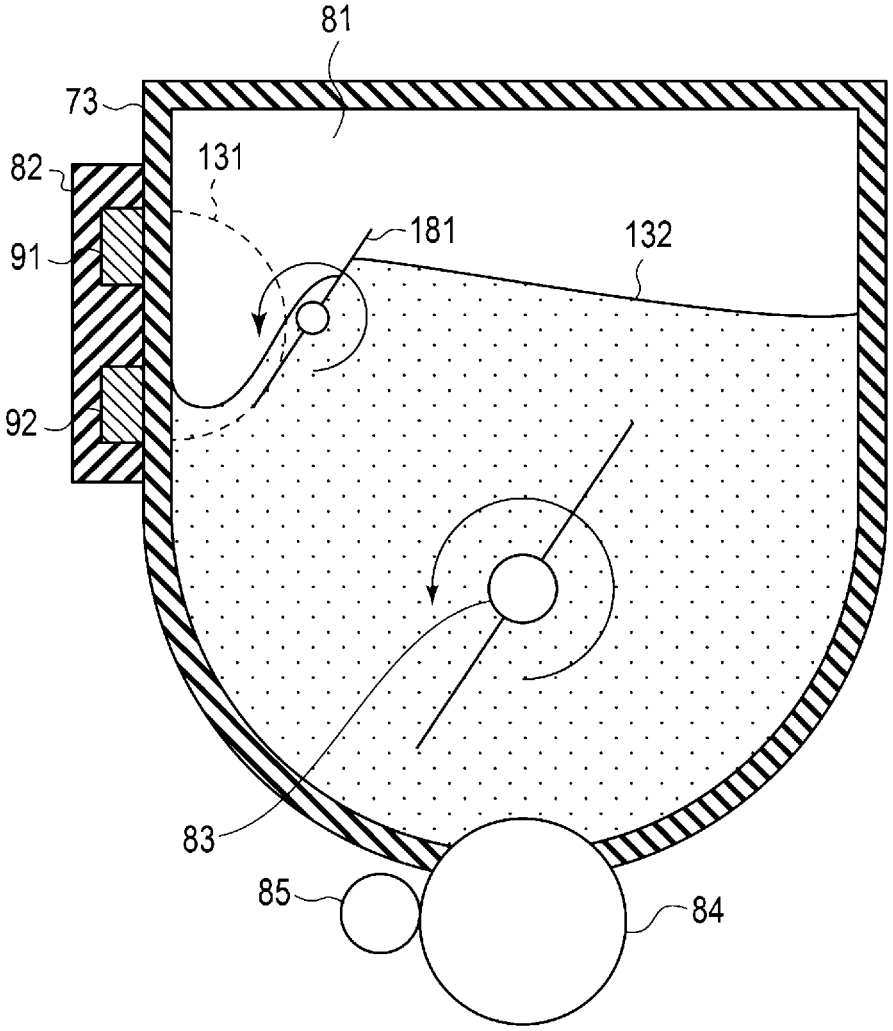
FIG. 8 is a diagram illustrating a modification of the developing device according to the first embodiment, according to an embodiment.

FIG. 8 is an explanatory diagram illustrating an example in which an auxiliary stirring mechanism 181 is added in the toner storage container 81.

The auxiliary stirring mechanism 181 is configured to stir the toner in the vicinity of the remaining toner sensor 82 in the toner storage container 81. The auxiliary stirring mechanism 181 includes a paddle for stirring in the toner storage container 81. The auxiliary stirring mechanism 181 causes the toner interface 132 to undulate in the toner storage container 81 by rotating the paddle. More specifically, the auxiliary stirring mechanism 181 is configured to undulate the toner interface 132 in the toner storage container 81 and within the detection range 131 of the remaining toner sensor 82.

Accordingly, the auxiliary stirring mechanism 181 can greatly change the amount of toner in the detection range 131. As a result, the change in capacitance detected by the remaining toner sensor 82 can be increased. As a result, the processor 21 can easily determine the remaining amount of toner based on the detection result of the remaining toner sensor 82.

The functions described in each of the above-described embodiments are not limited to being configured by using hardware and can also be realized by using software and loading a program describing each function into a computer. Each function may be configured by appropriately selecting either software or hardware.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

a developer configured to adhere toner to an electrostatic latent image on a photoconductor to form a toner image;

a toner container configured to supply toner to the developer, a toner interface being provided as a boundary between toner filled in the toner container and space in the toner container, the toner interface configured to undulate in the toner container;

a toner sensor configured to detect a capacitance between a first electrode and a second electrode spaced apart below from the first electrode;

a controller configured to determine a remaining amount of toner in the toner container based on detection information from the toner sensor; and a first toner supply configured to supply toner from a toner cartridge to the toner container, the controller being configured to control the operation of the first toner supply based on the determination of the remaining amount of toner in the toner container, the toner container comprises a second toner supply configured to supply toner to the developer, and the controller is configured to determine the remaining amount of toner in the toner container based on detection information from the toner sensor when the toner is filled in the toner container to a position of the toner interface higher than the first electrode and then the second toner supply operates by a predetermined amount or more.

2. The image forming apparatus of claim 1, wherein the controller is configured to determine the remaining amount of toner in the toner container based on a temporal change in capacitance between the first electrode and the second electrode while the toner interface undulates.

3. The image forming apparatus of claim 2, wherein the controller is configured to:

determine that the remaining amount of toner in the toner container is insufficient when an absolute value of the change in capacitance between the first electrode and the second electrode while the toner interface undulates is smaller than a threshold; and determine that the remaining amount of toner in the toner container is sufficient when the absolute value of the change is larger than the threshold.

4. The image forming apparatus of claim 1, wherein the controller is configured to operate the second toner supply that supplies toner to the developer based on the remaining amount of toner in the toner container.

5. The image forming apparatus of claim 1, wherein the first electrode and the second electrode are disposed on a resin outer wall surface of the toner container.

6. The image forming apparatus of claim 1, wherein the first electrode is configured to be in the toner container, and the second electrode is configured to be positioned below the first electrode in the vertical direction.

7. An image forming apparatus comprising:

a developer configured to adhere toner to an electrostatic latent image on a photoconductor to form a toner image;

a first toner supply configured to supply toner from a toner cartridge to the developer;

a mechanism configured to cause a toner interface to undulate in the toner cartridge, the toner interface being a boundary between toner filled in the toner cartridge and space in the toner cartridge;

a toner sensor configured to detect a capacitance between a first electrode and a second electrode spaced apart below the first electrode; and a controller configured to determine a remaining amount of toner in the toner cartridge based on detection information from the toner sensor, wherein the controller is configured to control the operation of the first toner supply based on the determination of the remaining amount of toner in the toner cartridge, a second toner supply configured to supply toner to the developer, and the controller is configured to determine the remaining amount of toner in the toner cartridge based on detection information from the toner sensor when the toner is filled in the toner cartridge to a position of the toner interface higher than the first electrode and then the second toner supply operates by a predetermined amount or more.

8. The image forming apparatus of claim 7, wherein the controller is configured to determine the remaining amount of toner based on a temporal change in capacitance between the first electrode and the second electrode while the toner interface undulates.

9. The image forming apparatus of claim 8, wherein the controller is configured to:

determine that the remaining amount of toner is insufficient when an absolute value of the change in capacitance between the first electrode and the second electrode while the toner interface undulates is smaller than a threshold; and determine that the remaining amount of toner in the toner container is sufficient when the absolute value of the change is larger than the threshold.

10. The image forming apparatus of claim 7, further comprising:

a processor configured to form the toner image, wherein the processor comprises a photosensitive drum, a charger, and a sub hopper.

11. The image forming apparatus of claim 10, wherein the photosensitive drum is a photoconductor comprising a cylindrical drum and a photosensitive layer disposed on an outer peripheral surface of the drum, the photosensitive drum being configured to rotate at a constant speed.

12. The image forming apparatus of claim 11, wherein the charger is configured to charge the surface of the photosensitive drum by applying a voltage to the photosensitive drum via a charging roller.

13. The image forming apparatus of claim 10, wherein the sub hopper is configured to receive toner from the toner cartridge, store the received toner, and supply the toner to the developer.

* * * * *